United States Patent [19]

Kitai et al.

[11] 4,383,458

[45] May 17, 1983

[54] FILM CUTTER

[75] Inventors: Makoto Kitai; Akira Ishida, both of Kyoto, Japan

[73] Assignee: Dainippon Screen Seizo Kabushiki Kaisha, Kyoto, Japan

[21] Appl. No.: 240,232

[22] Filed: Mar. 3, 1981

[30] Foreign Application Priority Data

Mar. 5, 1980 [JP] Japan ..... 55-29034[U]

[51] Int. Cl.[3] ..... B26D 9/00

[52] U.S. Cl. ..... 83/405; 83/376; 83/379; 83/455; 83/460; 83/488; 83/614

[58] Field of Search ..... 83/455, 456, 460, 508, 83/376, 379, 614, 405, 488

[56] References Cited

U.S. PATENT DOCUMENTS

| | | | |
|---|---|---|---|
| 1,380,492 | 6/1921 | Moore | 83/405 X |
| 1,967,324 | 7/1934 | Powers | 83/485 |
| 2,624,408 | 1/1953 | Stein | 83/485 |
| 3,532,018 | 10/1970 | Szabo | 83/455 |
| 3,620,114 | 11/1971 | Hudyk | 83/214 |
| 3,821,915 | 7/1974 | Larrable | 83/455 X |
| 3,958,477 | 5/1976 | Carlson | 83/508 X |

*Primary Examiner*—Donald R. Schran

*Attorney, Agent, or Firm*—Zarley, McKee, Thomte, Voorhees & Sease

[57] ABSTRACT

In the film cutter of this invention, a cutter carriage is guided by a guide rod of a circular cross section allowing it to make both a translational motion along the guide rod and a tilting motion about the guide rod, whereby a rotary blade mounted on the cutter carriage is assured of a close contact with a fixed linear blade irrespective of the thickness of the film to be cut for always attaining a satisfactory cutting action. And a film holder working in synchronism with the cutter carriage allows a roll of film to be cut into specified lengths in a sequential manner.

8 Claims, 3 Drawing Figures

FILM CUTTER

Figure 1:
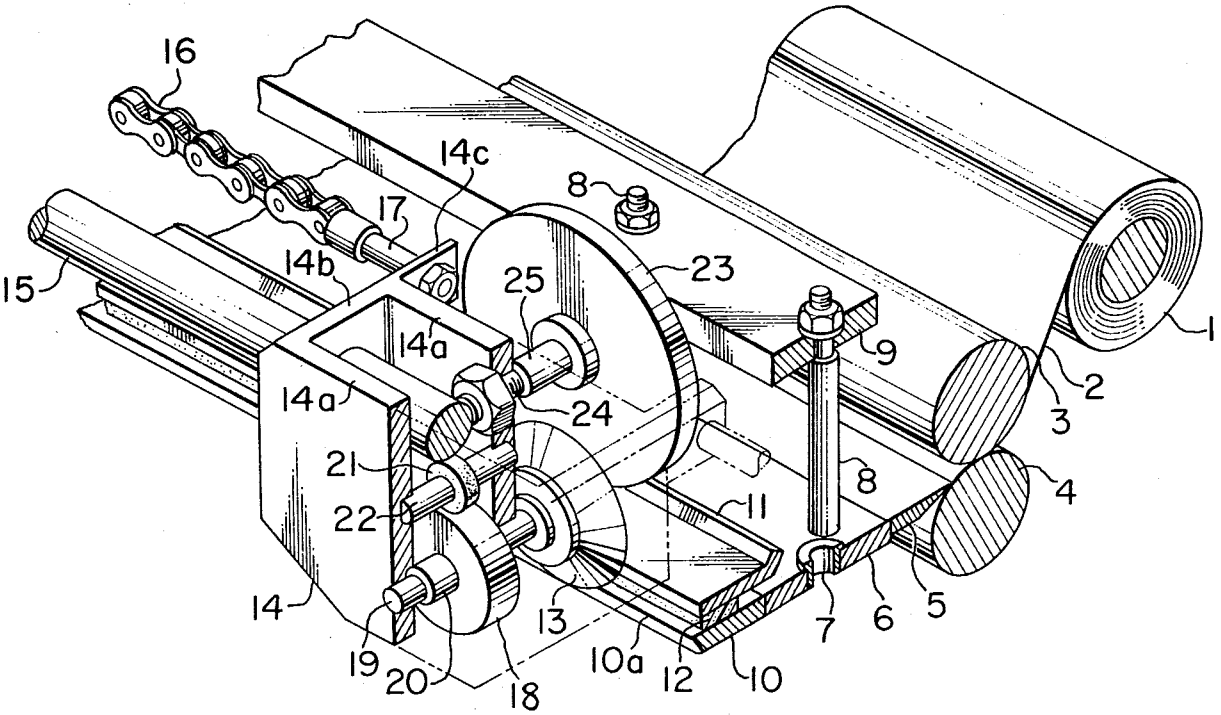

This invention relates to a film cutter and, in particular, to a film cutter which is provided with a pair of blades, of which one is a fixed linear blade and the other is a movable blade which can be moved along the fixed linear blade in parallel. The movable blade is preferably a rotary blade which is substantially shaped as a disc blade.

Film cutters of this type are widely known in the art and, in such cutters, the movable blade is required to be made to contact the fixed blade very closely while it undergoes a translational motion along the edge of the fixed linear blade, if the movable blade is not made to contact the fixed linear blade closely enough, a fold may be formed along the cut edge of the film, even if the film is ever cut through, or, in some cases, the film is not cut through at all by being merely folded along a line where the film is desired to be cut through.

Therefore, conventional film cutters of this sort are normally equipped with a guide of relatively sturdy construction for guiding the action of the movable blade along the fixed linear blade and maintaining certain pressure between the fixed linear blade and the movable blade. And, such guide is normally made of a plurality of rods or a rail of a rectangular cross-section for allowing the movable blade the freedom of motion only in one direction; i.e. along the edge of the fixed linear blade.

Accordingly, such devices have to be built relatively rigid thereby incurring relatively high cost and causing much work for manufacturing them since dimentional allowance must be precisely specified and observed. In addition, adjustments tend to become cumbersome for cutting film of various thicknesses.

In view of such shortcomings of conventional film cutters, the primary object of this invention is to provide an improved film cutter which is relatively economical to manufacture, easy to build and easily adaptible to various thicknesses of the film to be cut.

According to this invention, such an object is accomplished by providing a film cutter for cutting a strip of film fed out to a cutting area by means of a fixed linear blade arranged along the cutting area and a movable blade which can be moved along the fixed linear blade, comprising a film holder arranged over the fixed linear blade, biased toward the fixed linear blade by a spring means so as hold the film stationary therebetween while the film is being cut, a cutter carriage which carries the movable blade for moving it in parallel to the fixed linear blade, a pressure roller rotatively mounted on the carriage for applying pressure onto the film holder while the cutter carriage moves, a means for displacing the film holder away from the fixed linear blade for allowing smooth passage of the film therebetween when the cutter carriage has reached to at least one of the end areas of its moving stroke, and a guide member of a circular cross-section for guiding the motion of the carriage along the fixed linear blade and for pivoting the carriage thereabout so that the reaction force which the carriage receives as its pressure roller rolls on the film holder is directed to pressing the movable blade carried by the carriage against the fixed linear blade.

In what follows, this invention is explained in detail, making reference to a preferred embodiment thereof described in the appended drawings.

Figure 3:
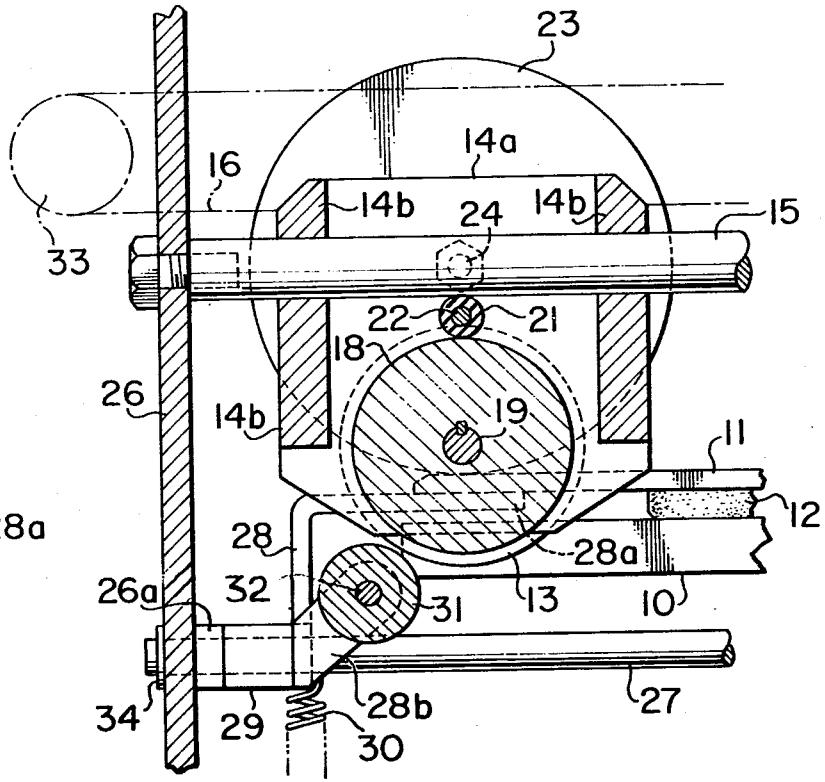
Figure 2:
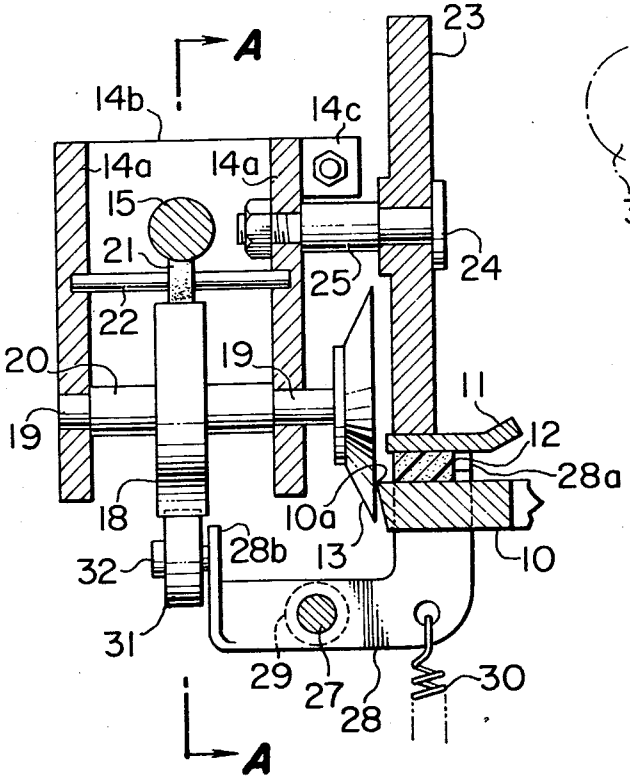

In the drawings, FIG. 1 is a perspective view of an essential part of an embodiment of the film cutter according to this invention, FIG. 2 is a cross-sectional side view of the film cutter of FIG. 1, and FIG. 3 is a cross-section front view, seen from line A—A of FIG. 2, of the film cutter of FIGS. 1 and 2.

Now, in FIG. 1, a roll of film 1 is rotatively supported at an appropriate location of the film cutter and the front edge of the film 2 fed out from the roll 1 is held between a pair of feed rollers 3 and 4 which are driven for feeding out the film 2 at appropriate timing. The film 2 is smoothly fed out over the punching plate 6 passing along the upper surface of a doctor blade 5 which is held against the lower pressure roller 4.

In the punch plate 6 are formed a plurality of punch dies 7 appropriately and a punch rod 8 is appended from a lateral bar 9 opposing each of the punch dies 7 so that the film placed therebetween may be punched by lowering the lateral bar 9 and inserting the punching rod 8 into a corresponding punch die 7. These punch holes formed in the film are used for positioning the film with proper register when mounting it in a plate-making camera, a photo-electric color scanner for plate-making or other exposure devices after cutting the film into a suitable length with this film cutter. Accordingly, the shape, dimensions and arrangement of the punch dies 7 and the punch rods 8 should be selected according to the particular application of the film.

Then, the film 2 is further fed out and brought out to a cutting area after passing between a fixed linear blade 10 with a sharp edge **10*a* and a film holder 11 underdside of which is attached a porous rubber or other soft material 12. When the film 2 is being fed out to the cutting area, the film holder 10 is slightly kept up away from the fixed blade 10 so as to allow smooth passage of the film 2 therebetween. Otherwise, the film holder 11 keeps the film 2 stationary, particularly when the film 2 is being cut, by virtue of the soft material 12** which produces frictional force without damaging the film surface.

When a specified length of the film 2 has projected out from the edge **12*a* of the fixed blade 12, the motion of the feed rollers 3 and 4 is terminated and the film 2 is cut through by means of a rotary blade 13 mounted on a cutter carriage 14 with a shaft 19**.

So far the film cutter of this invention is substantially the same as conventional film cutters. The advantage of assuring a close contact between the fixed linear blade and the movable rotary blade according to this invention is attained by the structure which is described in what follows.

The cutter carriage 14 is slidably fit onto a guide rod 15 of a circular cross-section extending laterally of the main body of the film cutter. The guide rod 15 is supported at its both ends by the side plates 26 (FIG. 3) of the main body and is driven laterally by a stretch of chain 16 passed around a drive sprocket 33 which is shown in FIG. 3 with an imaginary line. The cutter carriage 14 is connected to the chain 16 with a connecting members 17 which are fixed to brackets **14*c* projecting from the upper rear portions of the cutter carriage 14**.

The guide rod 15 penetrates through the two side end plates **14*b* of the cutter carriage 14 so that the cutter carriage 14 may be slidable along the guide rod 15 and rotatable about the guide rod 15**.

As mentioned before, the rotary blade 13 is mounted on the shaft 19 which is rotatively supported by the front and rear plates 14*a* of the cutter carriage 14. A drive wheel 18 is also mounted on the same shaft 19 between the two plates 14*a* with the help of a pair of sleeves 20 so that the drive wheel and the rotary blade 13 are integrally connected.

An intermediate wheel 21, which is suitably made of rubber or other elastic and frictional material, is mounted on a shaft 22 whose two ends are pivoted in the front and rear plates 14*a* of the cutter carriage 14 so as to be held between the guide rods 15 and the drive wheel 18 for transmitting the translational motion of the carriage along the guide rod 15 to the drive wheel 17. In other words, as the cutter carriage 14 is moved along the guide rod 15 by the chain 16, the translational motion of the carriage 14 is converted into the rotary motion of the rotary blade 13 via the intermediate wheel 21 and the drive wheel 18.

In addition, a pressure roller 23 is rotatively mounted on a cantilever shaft 24 fixed in the rear plate 14*a* of the cutter carriage 14 with the help of a sleeve 25. When the cutter carriage 14 is driven along the guide rod 15, the pressure roller 23 rolls over the film holder 11 applying pressure thereon. Now, as best seen from FIG. 2, the pressure roller 23 receives a restoring force from the soft material 12 attached on the lower surface of the film holder 11 and is pushed upward thereby causing the rotative motion of the cutter carriage 14 about the guide rod 15 in the counter-clockwise direction as seen in the drawing. This rotating motion in turn causes the rotary blade 13 to be pushed against the fixed linear blade 10 so as to maintain a closely contacted state which is required for attaining an effective cutting action.

Now referring to FIG. 3 in addition to FIG. 2, it can be seen that a swing lever 28 is pivoted at each of the two end portions of a lateral bar 27 which extends between the two side plates 26 of the film cutter with its both ends held by snap rings 34. The swing level 28 held in place with the help of a sleeve 29 and a boss 26*a* extending from the side plate 26 is biased in the clockwise direction by a coil spring 30.

One end 28*b* of the swing lever 28 is bent at about 90 degrees inwardly of the main body and carries a roller 31 pivoted on a shaft 32. And, the other end 28*a* is bent 90 degrees upwardly and then 90 degrees inwardly of the main body and attached to the lower surface of the end of the film holder 11. Therefore, when the drive wheel 17 rides over the roller 31 as the cutter carriage 14 approaches an end of its moving stroke, one end 28*b* of the swing lever 28 is pushed downward thereby pushing the other end 28*a* of the swing lever 28 upward. As a matter of course, this arrangement is provided at each end of the film holder 11.

In short, when the cutter carriage 14 reaches the end of its moving stroke or when the film 2 is completely cut through, the film holder 11 is lifted up so as to allow new portion of the film 2 to be fed out to the cutting area from between the film holder 11 and the fixed linear blade 10. In this conjunction, it is appropriate to select the total length of the film holder 11 slightly shorter than the moving stroke of the cutter carriage 14.

Thus, the film 2 taken out from the roll 1 is first fed out over the punching plate 5 and accordingly punched out. Then it is projected out from the cutting edge 10*a* of the fixed linear blade 10 and cut through by the rotary blade 13 into a specified length. And, after each cutting action, the film holder 11 is lifted upward for allowing fresh part of the film brought to the cutting area. And these process can be repeated until the roll of film 1 is completely fed out.

It can be clearly seen from the above description that the rotary blade is always properly pushed against the fixed linear blade irrespective of the thickness of the film. Actually, the pressure is automatically adjusted by the thickness of the film to be cut. And, the guide means is not required to be rigid but, rather, made to allow certain freedom of motion to the cutter carriage for accomplishing the automatic adjustment of the pressure.

Although the present invention was described with respect to a preferred embodiment thereof, it is obvious to a person skilled in the art that there are a number of possible variations and modifications for accomplishing the same object without departing from the spirit of this invention. For example, the rotary blade 13 used in the described embodiment can be a linear blade which is movable along the fixed linear blade 10. It is thus to be understood that the present invention is not limited by the preferred embodiment thereof but solely by the appended claims.

We claim:

1. A film cutter for cutting a strip of film fed out to a cutting area having: a fixed linear blade arranged along the cutting area and a movable blade which can be moved along the fixed linear blade, comprising:

a film holder arranged over the fixed linear blade, biased toward the linear fixed blade by a spring means so as to hold the film stationary while it is being cut;

a cutter carriage which carries the movable blade for moving it in parallel to the fixed linear blade;

a pressure roller, rotatively mounted on the carriage for applying pressure onto the film holder while the cutter carriage moves;

a means for displacing the film holder away from the fixed linear blade for allowing smooth passage of the film therebetween when the cutter carriage has reached to at least one of the end areas of its moving stroke; and a guide member of a circular cross-section for guiding the motion of the carriage along the fixed linear blade and for pivoting the carriage thereabout so that the reaction which the carriage receives as its pressure roller rolls on the film holder is directed to pressing the movable blade carried by the carriage against the fixed linear blade.

2. A film cutter according to claim 1, wherein the movable blade is a rotary blade shaped substantially as a disc which rotates at least while it cuts through the film.

3. A film cutter according to claim 1, wherein the carriage is moved along the fixed linear blade by a chain which undergoes a reciprocating motion driven by a power means.

4. A film cutter according to claim 3, wherein the rotary blade derives its rotary motion from the power of the chain via intermediate wheels at least one of which rolls over a stationary member.

5. A film cutter according to claim 4, wherein the stationary member is the guide member.

6. A film cutter according to claim 5, wherein one of the intermediate wheels rides over an end of a lever when the carriage has reached an end area of its moving stroke and, at the same time, the other end of the lever lifts up the film holder away from the fixed linear blade for smooth passage of the film therebetween.

7. A film cutter according to claim 6, wherein the film is fed out from a roll of film and the film is cut and fed out to the cutting area over and over in a sequential manner.

8. A film cutter according to claim 7, wherein the film cutter is further provided with a punching means for making a plurality of register holes in the film.

* * * * *